US010392782B2

(12) United States Patent
Jeon et al.

(10) Patent No.: US 10,392,782 B2
(45) Date of Patent: Aug. 27, 2019

(54) CONTROL VALVE FOR CONSTRUCTION EQUIPMENT

(71) Applicant: VOLVO CONSTRUCTION EQUIPMENT AB, Eskilstuna (SE)

(72) Inventors: Man-Seuk Jeon, Gyeongsangnam-do (KR); Bon-Seuk Ku, Gyeongsangnam-do (KR)

(73) Assignee: Volvo Construction Equipment AB, Eskilstuna (SE)

( * ) Notice: Subject to any disclaimer, the term of this patent is extended or adjusted under 35 U.S.C. 154(b) by 65 days.

(21) Appl. No.: 15/535,052

(22) PCT Filed: Dec. 29, 2014

(86) PCT No.: PCT/KR2014/012991
§ 371 (c)(1),
(2) Date: Jun. 11, 2017

(87) PCT Pub. No.: WO2016/108300
PCT Pub. Date: Jul. 7, 2016

(65) Prior Publication Data

US 2017/0342686 A1 Nov. 30, 2017

(51) Int. Cl.
*E02F 9/22* (2006.01)
*F15B 11/08* (2006.01)
(Continued)

(52) U.S. Cl.
CPC ..... *E02F 9/2267* (2013.01); *E02F 9/22* (2013.01); *E02F 9/2225* (2013.01); *E02F 9/2271* (2013.01); *E02F 9/2285* (2013.01); *F15B 11/003* (2013.01); *F15B 11/08* (2013.01); *F15B 13/015* (2013.01); *F15B 13/027* (2013.01); *F15B 13/0402* (2013.01);
(Continued)

(58) Field of Classification Search
CPC ..... F15B 11/003; F15B 13/01; F15B 11/205; F15B 2211/782; E02F 9/2267; E02F 9/2203; E02F 9/2225
USPC ..... 60/459
See application file for complete search history.

(56) References Cited

U.S. PATENT DOCUMENTS 6,907,815 B2 * 6/2005 Kim ..... E02F 9/226 91/442

FOREIGN PATENT DOCUMENTS

EP 0362409 A1 4/1990
EP 1227249 A1 7/2002
(Continued)

OTHER PUBLICATIONS

European Official Action (dated Jul. 13, 2018) for corresponding European App. EP 14 909 582.0.
(Continued)

*Primary Examiner* — Michael Leslie
*Assistant Examiner* — Daniel S Collins
(74) *Attorney, Agent, or Firm* — Sage Patent Group

(57) ABSTRACT

A control valve is provided for construction equipment having a holding valve which prevents the natural lowering of an operation apparatus due to the dead weight of the operation apparatus when an actuator is in a neutral position. The control valve includes a valve body, a spool, a holding valve, a control valve, and a pilot pressure control valve. The control valve can save manufacturing cost as well as allow better use of space for construction equipment.

10 Claims, 4 Drawing Sheets

(51) Int. Cl.

| | |
|---|---|
| ***F15B 11/00*** | (2006.01) |
| ***F15B 13/01*** | (2006.01) |
| ***F15B 13/02*** | (2006.01) |
| ***F15B 13/04*** | (2006.01) |
| *E02F 3/42* | (2006.01) |

(52) U.S. Cl.
CPC ..... *F15B 13/0405* (2013.01); *E02F 3/42* (2013.01); *F15B 2211/205* (2013.01); *F15B 2211/575* (2013.01)

(56) References Cited

FOREIGN PATENT DOCUMENTS

| | | | |
|---|---|---|---|
| GB | 2402174 | A | 12/2004 |
| JP | 09269001 | A | 10/1997 |
| KR | 100518768 | B1 | 10/2005 |
| KR | 20090028216 | A | 3/2009 |
| KR | 100952741 | B1 | 4/2010 |
| KR | 1020100072683 | A | 7/2010 |
| KR | 1020130132499 | A | 12/2013 |
| KR | 20040102597 | A | 12/2014 |

OTHER PUBLICATIONS

International Search Report (dated Sep. 21, 2015) for corresponding International App. PCT/KR2014/012991.

* cited by examiner

[Fig. 1]
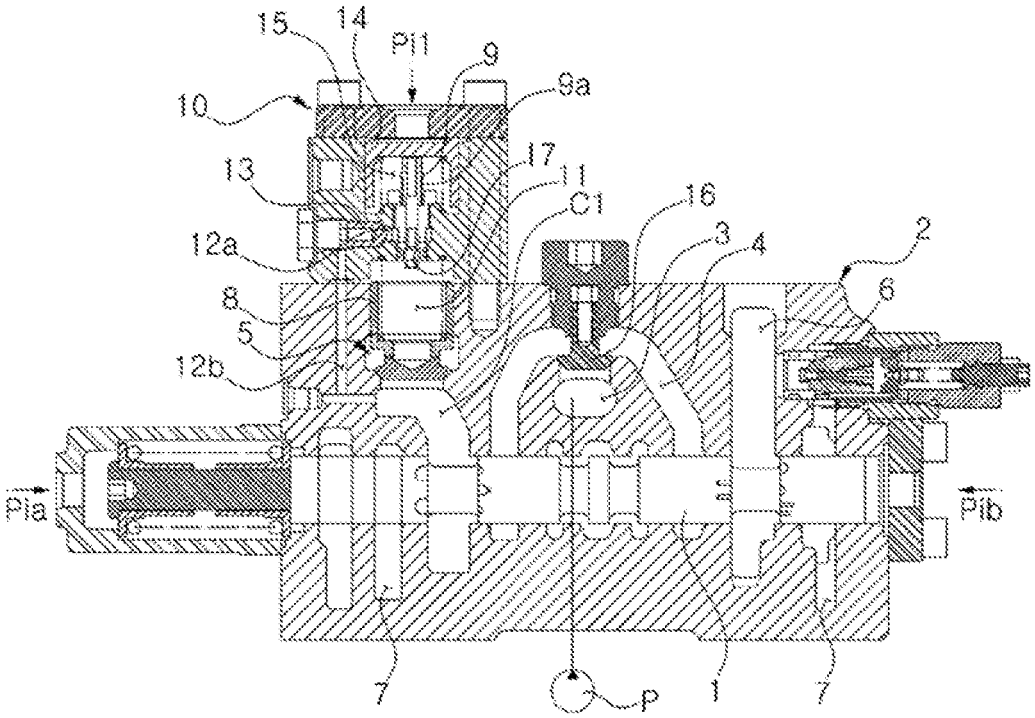
[Fig. 2]
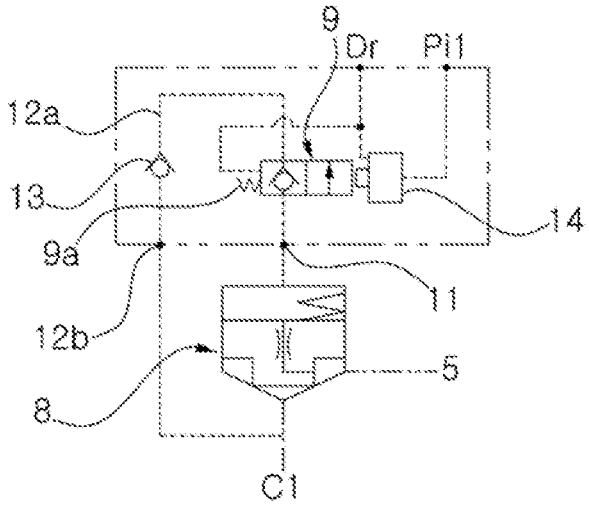

[Fig. 3]
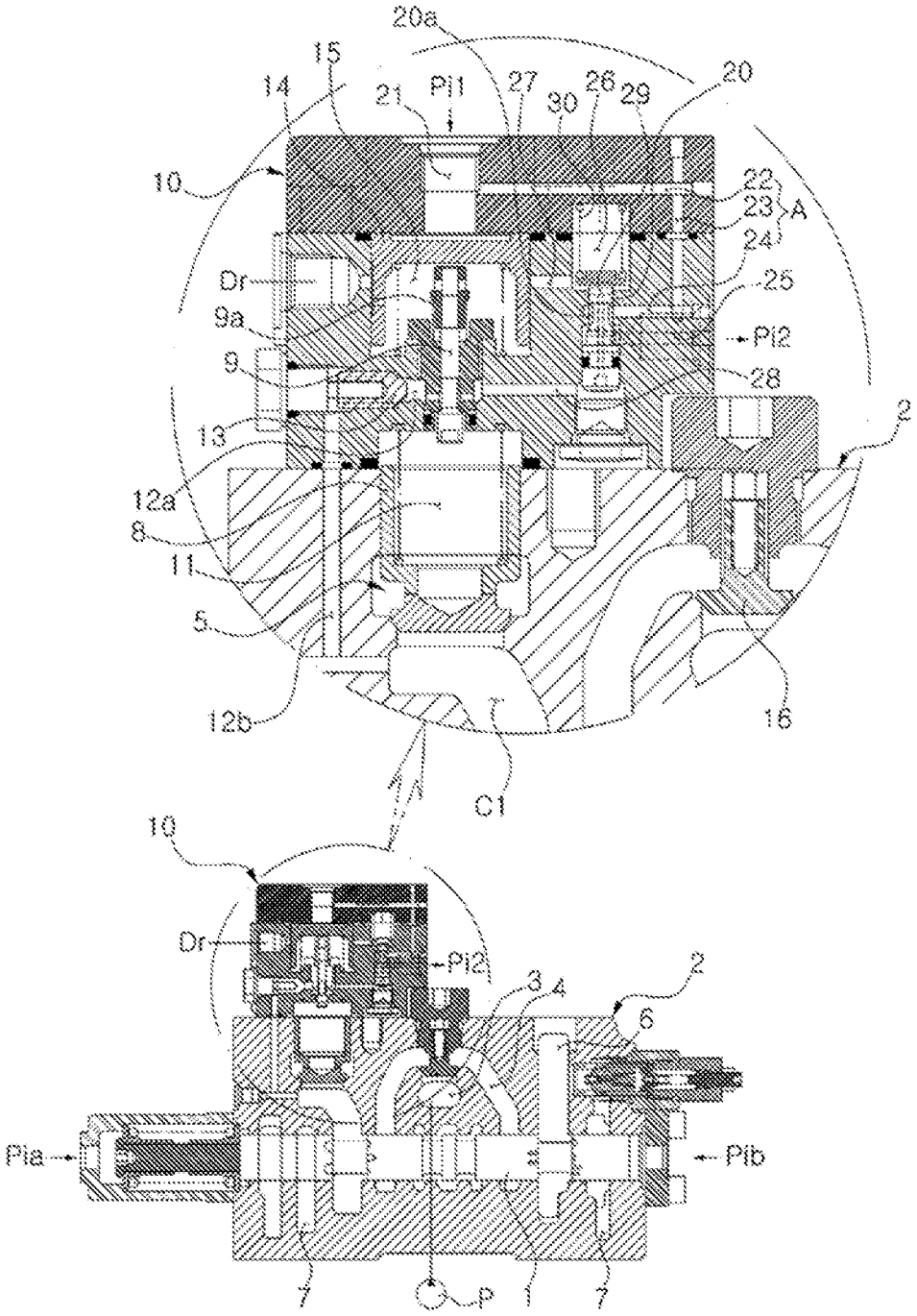

[Fig. 4]
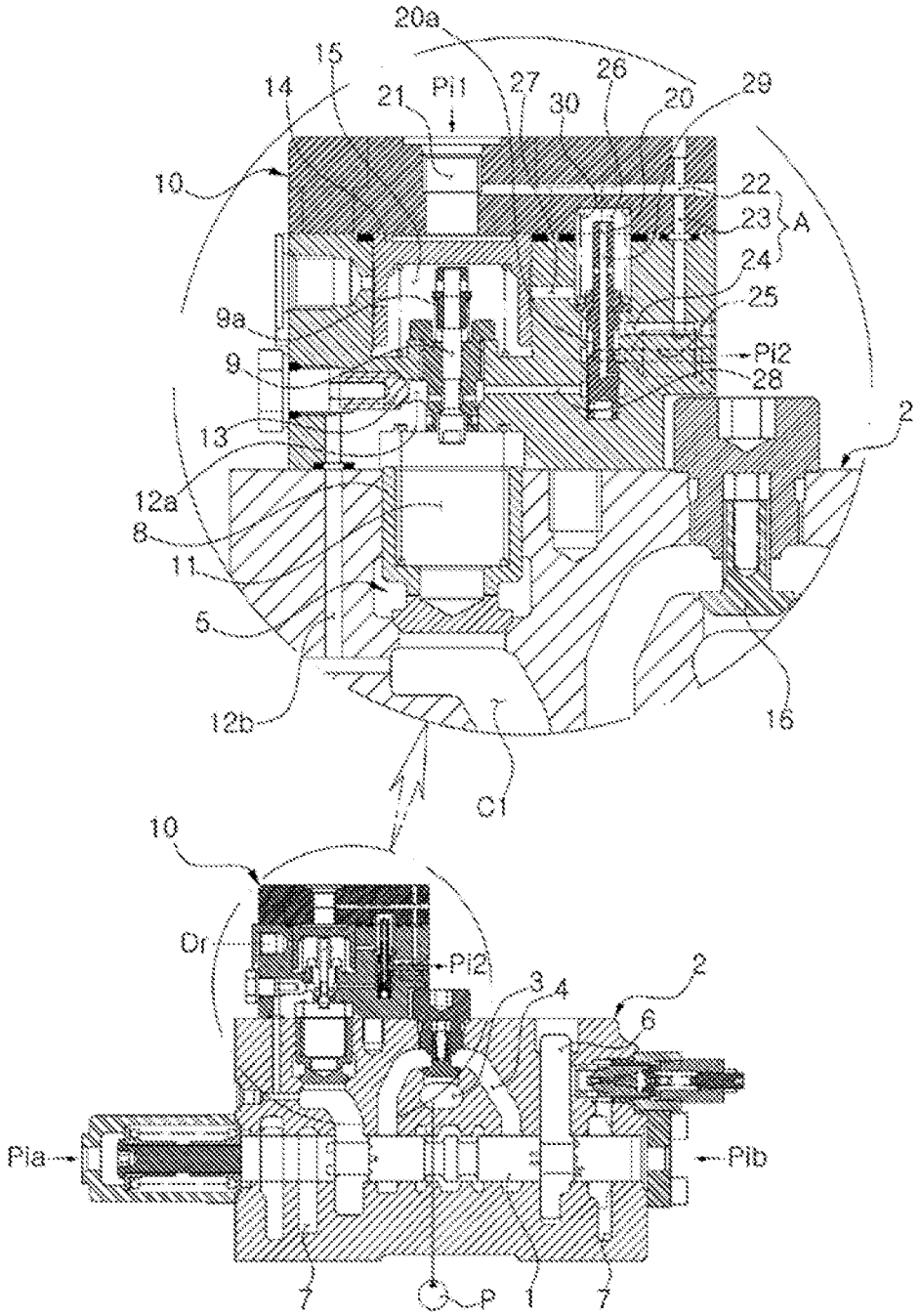

[Fig. 5]
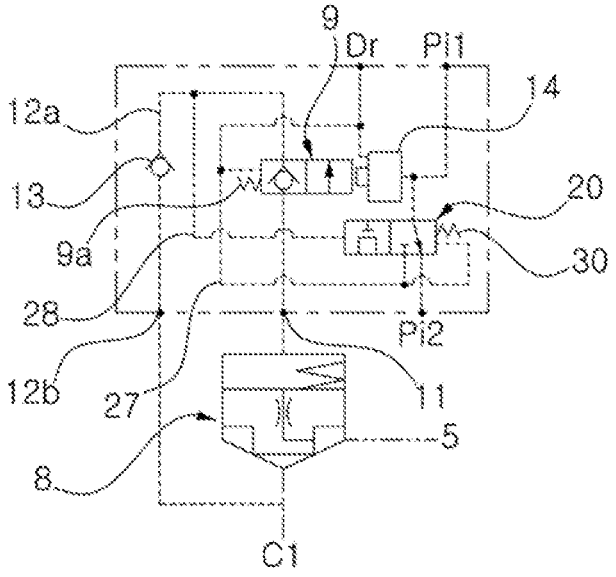
[Fig. 6]
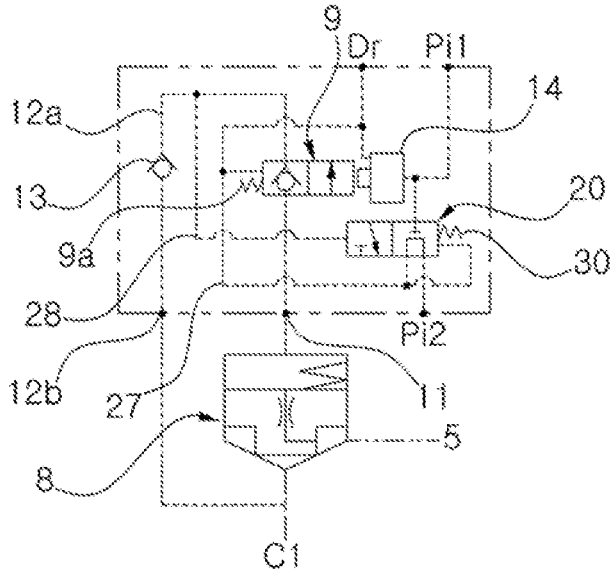

CONTROL VALVE FOR CONSTRUCTION EQUIPMENT

BACKGROUND AND SUMMARY

The present invention relates to a control valve for construction equipment, and more particularly, a control valve for construction equipment having a holding valve to prevent the work device from descending due to its own weight when an actuator like the boom cylinder is in a neutral state FIG. 1 is a sectional view of a control valve for construction equipment according to the conventional technology, and FIG. 2 is a hydraulic circuit diagram of the holding valve illustrated in FIG. 1.

Referring to FIGS. 1 and 2, the control valve for the construction equipment according to the conventional technology includes a valve body (2) having a spool that is installed between a hydraulic pump (P) and an actuator in order to drive the actuator (e.g. boom cylinder) using the hydraulic fluid of the hydraulic pump (P).

The valve body is configured with a pump passage (3) to which the hydraulic fluid is supplied from the hydraulic pump (P), a supply passage (4) communicating with the pump passage (3), and the actuator ports (5,6) connected to the actuator.

If the spool is shifted to the left or right direction by applying the pilot pressure (Pia or Pib), the hydraulic fluid of the hydraulic pump (P) is supplied to the actuator through one side of the actuator port (5), and the hydraulic fluid discharged from the actuator can be returned to a tank passage (7) through the other side of the actuator port (6).

In order to prevent the work device from descending when the spool (1) is in the neutral state, a holding poppet (8) is formed on the actuator port (5) so as to hold temporarily the load of the actuator.

The back pressure chamber of the holding poppet (8) is connected with a holding valve (10) having an auxiliary spool (9) which is shifted by the pilot pressure to release the holding load of the actuator.

A check valve (13) being able to open and close is installed on a drain path (12*a*) where the hydraulic fluid drained from a back pressure chamber (11) by the shift of the auxiliary spool (9) is transferred.

A piston (14) is installed on a back pressure chamber (15) of the auxiliary spool (9) and shifts the auxiliary spool when a pilot pressure (Pi1) is applied.

In order to shift the spool (1) to the left in the figure, a pilot pressure (Pib) is applied to the right pilot port of the valve body (2) while the pilot pressure (Pi1) is applied to the pilot port of the holding valve (10). Thus, the spool (1) is shifted to the left, and the auxiliary spool (9) is shifted downwards by the piston (14) activated by the pilot pressure (Pi1) (Refer to FIG. 1).

If the spool (1) is shifted to the left in the figure, the hydraulic fluid supplied to the pump passage (3) from the hydraulic pump (P) pushes a check valve (16) upwards, and is transferred to the supply passage (4). The hydraulic fluid transferred to the supply passage (4) is supplied to the actuator (e.g. boom cylinder) through the actuator port (6).

At this time, the hydraulic fluid discharged from the actuator is transferred to the actuator port (5), pushes up the holding poppet (8), passes through port (C1) to spool (1), and is drained to tank passage (7).

On the other hand, if the auxiliary spool (9) is shifted downwards in the figure, the hydraulic fluid of the holding poppet (8) passes through a path (17) that is opened by the shift of the auxiliary spool (9), and releases the checking function of the check valve (13) that is installed on the drain path (12*a*). Thus, the checking function of the holding poppet (8) can be released as the hydraulic fluid of the back pressure chamber (11) passes through the path (17) and the drain paths (12*a*, 12*b*), and is drained to the port (C1).

Also, if the spool (1) is shifted to the right in the figure by the pilot pressure (Pia) applied to the left pilot port, the hydraulic fluid supplied to the pump passage (3) from the hydraulic pump (P) pushes the check valve (16) upwards, is transferred to the supply passage (4), pushes up the holding poppet (8) on the actuator port, and then is supplied to the actuator through the actuator port (5). At this time, the hydraulic fluid discharged from the actuator passes through the actuator port (6) and the spool (1), and is drained to the tank passage (7).

If the spool (1) is to be shifted to the left in the figure, the pilot pressure (Pib) is applied to the right end of the spool (1) with the pilot pressure (Pi1) simultaneously applied to the piston (14).

If the pilot line and control valve (not shown in the figure) are added for newly generating the pilot pressure in order to shift another control valve other than the control valve in FIG. 1, the pilot line and control valve are installed in the outside of the valve body (2). Accordingly, the additional installation of the pilot line and control valve not only increases the manufacturing cost, but makes the space surrounding the valve body (2) confined, which causes inconvenience during the maintenance.

It is desirable to provide a control valve for construction equipment, in which a supply passage of pilot pressure and a control valve are formed within a holding valve, thereby saving the manufacturing cost as well as allowing better use of space.

In accordance with one aspect of an embodiment of the present invention, there is provided a control valve for construction equipment comprising; a valve body having a pump passage to which hydraulic fluid is supplied from a hydraulic pump, a supply passage that is configured to communicate with the pump passage, and actuator ports that is connected to an actuator; a spool that is installed within the valve body and shifted to enable the hydraulic fluid of the hydraulic pump to be supplied to the actuator through one of the actuator ports, and to return the hydraulic fluid discharged from the actuator to the tank passage through the other of the actuator ports; a holding valve that is provided with a holding poppet which is formed on one of the actuator ports and an auxiliary spool which is connected to a back pressure chamber of the holding poppet and shifted by a pilot pressure so as to release a holding load of the actuator; a control valve that is installed within the valve body (defined as a control valve to be shifted by the pilot pressure (Pi2); and a pilot pressure control valve that is shiftably installed within the holding valve and configured to apply or block the pilot pressure to the control valve through flow paths the pilot pressure, wherein the pilot pressure control valve is to be shifted by a pressure of hydraulic fluid drained from the back pressure chamber of the holding poppet when the auxiliary spool is shifted.

According to another aspect of the present invention, the actuator is the boom cylinder or the arm cylinder.

The pilot pressure control valve is formed of a poppet type pilot pressure control valve having a check function.

The pilot pressure control valve is also formed of a spool type pilot pressure control valve.

The flow paths comprise; a first flow path that is formed in the holding valve so that an inlet of the first flow path is communicating with a first pilot port to which the pilot pressure is applied so as to shift the auxiliary spool; a second flow path with its inlet connected to an outlet of the first flow path; and a third flow path in which an outlet of the third flow path is communicating with a second pilot port to which the pilot pressure is applied while an inlet of the third flow path is connected to an outlet of the second flow path, wherein the outlet of the third flow path is opened or closed by the shift of the pilot pressure control valve.

The holding valve includes a fourth flow path to which hydraulic fluid of a back pressure chamber of the pilot pressure control valve is drained when the pilot pressure control valve is shifted.

The holding valve includes a fifth flow path in which hydraulic fluid drained from the back pressure chamber of the holding poppet is supplied to a pressure receiving port of the pilot pressure control valve when the auxiliary spool is shifted.

The pilot pressure control valve includes a sixth flow path which selectively communicates the second pilot port with the back pressure chamber of the pilot pressure control valve in order to drain a pilot pressure of the second pilot port, if the pilot pressure applied to the control valve is blocked by the pilot pressure control valve shifted by a pressure of the hydraulic fluid pressure drained from the back pressure chamber of the holding poppet when the auxiliary spool is shifted.

According to other aspect of the present invention, the pilot pressure control valve shifted in an initial state opens an inlet through which the pilot pressure is applied to the control valve so as to shift the auxiliary spool, wherein the pilot pressure control valve shifted in an on-state where hydraulic fluid drained from the back pressure chamber of the holding poppet is applied to a pressure receiving port of the pilot pressure control valve by shifting the auxiliary spool blocks the inlet so that the pilot pressure is not applied to the control valve.

Further, the pilot pressure control valve shifted in an initial state blocks an inlet so that the pilot pressure is not applied to the control valve, wherein the pilot pressure control valve shifted in an on-state where hydraulic fluid drained from the back pressure chamber of the holding poppet is applied to a pressure receiving port of the pilot pressure control valve by shifting the auxiliary spool opens the inlet so that the pilot pressure is applied to the control valve.

According to the embodiment of the present invention having the above-described configuration, a supply path of pilot pressure and a pilot pressure control valve are installed within a holding valve in order to shift the control valve installed in the valve body, thereby saving the manufacturing cost as well as allowing better use of space.

BRIEF DESCRIPTION OF THE DRAWINGS

FIG. 1 is a sectional view of a control valve for construction equipment according to the conventional technology.

FIG. 2 is a hydraulic circuit diagram of a control valve for construction equipment according to the conventional technology.

FIG. 3 is a sectional view of a control valve for construction equipment according to the embodiment of the present invention.

FIG. 4 is a sectional view of a control valve for construction equipment according to another embodiment of the present invention.

FIG. 5 is a hydraulic circuit diagram of a holding valve of a control valve for construction equipment according to the embodiment of the present invention.

FIG. 6 is another hydraulic circuit diagram of a holding valve of a control valve for construction equipment according to the embodiment of the present invention.

EXPLANATION OF REFERENCE NUMERALS FOR MAIN PARTS IN THE DRAWING

1; spool
2; valve body
3; pump passage
4; supply passage
5, 6; actuator port
7; tank passage
8; holding poppet
9; auxiliary spool
10; holding valve
11, 15, 26; back pressure chamber
12*a*, 12*b*; drain path
13, 16; check valve
14; piston
17; path
20; pilot pressure control valve

DETAILED DESCRIPTION

Hereinafter, a control valve for construction equipment according to a preferred embodiment of the present invention will be described in detail with reference to the accompanying drawings.

FIG. 3 is a sectional view of the control valve for construction equipment according to the embodiment of the present invention. FIG. 4 is a sectional view of the control valve for construction equipment according to another embodiment of the present invention. FIG. 5 is a hydraulic circuit diagram of the holding valve of the control valve for construction equipment according to the embodiment of the present invention. FIG. 6 is another hydraulic circuit diagram of the holding valve of the control valve for construction equipment according to the embodiment of the present invention.

Referring to FIGS. 3 and 5, the control valve for construction equipment according to the embodiment of the present invention includes an actuator (e.g. boom cylinder, arm cylinder) operated by the hydraulic fluid of a hydraulic pump (P) and a valve body (2) (e.g. MCV) having a spool (1) between the hydraulic pump (P) and the actuator.

The valve body is configured with a pump passage (3) to which hydraulic fluid is supplied from the hydraulic pump (P), a supply passage (4) communicating with the pump passage (3), and the actuator ports (5, 6) connected to the actuator.

If the spool is shifted to the left or right direction by applying a pilot pressure (Pia or Pib), the hydraulic fluid of the hydraulic pump (P) is supplied to the actuator through one of the actuator port (5), and the hydraulic fluid discharged from the actuator can be returned to the tank passage (7) through the other of the actuator port (6).

A holding poppet (8) is installed on either one of the actuator ports (5, 6), and a holding valve having an auxiliary spool (9) that is shifted by a pilot pressure (Pi1) to release a holding load of the actuator is connected to the back pressure chamber (11) of the holding poppet (8).

A control valve (not shown in the figure) that is shifted by a pilot pressure (Pi2) is installed within the valve body (2) (not shown) or at another valve body formed nearby the valve body (2).

A pilot pressure control valve (20) is shiftably installed within the holding valve (10), which is configured to allow the pilot pressure (Pi1) to a control valve (not shown) through flow paths (A) or block the pilot pressure (Pi1), wherein the pilot pressure control valve (20) is to be shifted by a pressure of hydraulic fluid drained from the back pressure chamber (II) of the holding poppet (8) when the auxiliary spool (9) is shifted.

The pilot pressure control valve is formed of a poppet type pilot pressure control valve having a check function (FIG. 3).

The pilot pressure control valve is also formed of a spool type pilot pressure control valve (FIG. 4).

The flow paths (A) include a first flow path (22) formed in the holding valve (10) so that an inlet of the first flow path is communicating with a first pilot port (21) to which the pilot pressure is applied so as to shift the auxiliary spool (9);

a second flow path (23) with its inlet connected to an outlet of the first flow path (22); and, a third flow path (24) in which an outlet of the third flow path (24) is communicating with a second pilot port (25) to which the pilot pressure is applied, while an inlet of the third flow path (24) is connected to an outlet of the second flow path (23) and the outlet of the third flow path (24) is opened or closed by the shift of the pilot pressure control valve (20).

A fourth flow path (27) is installed within the holding valve (10), in which hydraulic fluid of a back pressure chamber (26) of the pilot pressure control valve (20) is drained when the pilot pressure control valve (20) is to be shifted.

A fifth flow path (28) is installed within the holding valve (10), in which hydraulic fluid drained from the back pressure chamber (11) of the holding poppet (8) is supplied to a pressure receiving port of the pilot pressure control valve (20) when the auxiliary spool (9) is shifted.

The pilot pressure control valve (20) may further include a sixth flow path (29) which selectively communicates the second pilot port (25) with the back pressure chamber (26) of the pilot pressure control valve (20) in order to drain a pilot pressure of the second pilot port (25), if the pilot pressure (Pi2) applied to the control valve is blocked by the pilot pressure control valve (20) shifted by a pressure of the hydraulic fluid drained from the back pressure chamber (11) of the holding poppet (8) when the auxiliary spool (9) is shifted.

As shown in FIG. 5, the pilot pressure control valve (20) shifted in an initial state opens an inlet through which the pilot pressure (Pi1) is applied to the control valve so as to shift the auxiliary spool (9), and the pilot pressure control valve (20) shifted in an on-state where hydraulic fluid drained from the back pressure chamber (11) of the holding poppet (8) is applied to a pressure receiving port of the pilot pressure control valve (20) by shifting the auxiliary spool (9) blocks the inlet so that the pilot pressure (Pi1) is not applied to the control valve.

As shown in FIG. 6, the pilot pressure control valve (20) blocks the opening part in the initial state so that the pilot pressure (Pi1) is not applied to the control valve, and opens the opening part so that the pilot pressure (Pi1) is applied to the control valve when the auxiliary spool (9) is shifted to on-state as the hydraulic fluid drained from the back pressure chamber (11) of the holding poppet (8) is applied to the hydraulic pressure port of the pilot pressure control valve (20) shifted in an initial state blocks an inlet so that the pilot pressure (Pi1) is not applied to the control valve, and the pilot pressure control valve (20) shifted in an on-state where hydraulic fluid drained from the back pressure chamber (11) of the holding poppet (8) is applied to a pressure receiving port of the pilot pressure control valve (20) by shifting the auxiliary spool (9) opens the inlet so that the pilot pressure (Pi1) is applied to the control valve.

In order to shift the spool (1) to the left in the figure, the pilot pressure (Pib) is applied to the right pilot port of the valve body (2) while the pilot pressure (Pi1) is applied to the first pilot port (21) of the holding valve (10). Thus, as shown in FIG. 2, the spool (1) is shifted to the left, and the auxiliary spool (9) is shifted downwards by the piston (14) activated by the pilot pressure (Pi1).

If the spool (1) is shifted to the left in the figure, the hydraulic fluid supplied to the pump passage (3) from the hydraulic pump (P) pushes the check valve (16) upwards, and flows to the supply passage (4). The hydraulic fluid of the supply passage (4) is supplied to the actuator (e.g. boom cylinder) through the actuator port (6).

At this time, the hydraulic fluid discharged from the actuator flows into the actuator port (5), pushes up the holding poppet (8), passes through port (C1) to spool (1), and is drained to tank passage (7).

Also, if the spool (1) is shifted to the right in the figure by the pilot pressure (Pia) applied to the left pilot port, the hydraulic fluid supplied to the pump passage (3) from the hydraulic pump (P) pushes the check valve (16) upwards, is transferred to the supply passage (4), pushes up the holding poppet (8) on the actuator port, and then is supplied to the actuator through the actuator port (5). At this time, the hydraulic fluid discharged from the actuator passes through the actuator port (6) and the spool (1), and is drained to the tank passage (7).

On the other hand, if the auxiliary spool (9) is shifted downwards in the figure in order to shift the spool (1) to the left in the figure, the hydraulic fluid of the back pressure chamber (11) of the holding poppet (8) passes through the passage (17) that is opened by the shift of the auxiliary spool (9), and releases the check function of the check valve (13) that is installed on the drain path (12*a*). Thus, the check function of the holding poppet (8) can be released as the hydraulic fluid of the back pressure chamber (11) passes through the passage (17) and the drain paths (12*a*, 12*b*), and is drained to the port (C1), while the hydraulic fluid of the actuator port (5) pushes up the holding poppet (8) without the check function and flows into the port (C1).

A part of the pilot pressure (Pi1) applied to the first pilot port (21) for shifting the auxiliary spool (9) passes through the first flow path (22) communicating with the first pilot port (21), the second flow path (23) communicating with the first flow path (22), the third flow path (24) communicating with the second flow path (23), and the groove (20*a*) of the pilot pressure control valve (20), sequentially, and flows to the second pilot port (25) for applying the pilot pressure (Pi2) to the control valve. At this moment, the pilot pressure control valve (20) is shifted downwards due to the elastic force of the valve spring (30) that is installed in the back pressure chamber (26) of the pilot pressure control valve (20), which results in the communication between the third flow path (24) and the second pilot port (25).

Thus, in order to shift the auxiliary spool (9), the pilot pressure (Pi1) can be applied by the pilot pressure control valve (20) through the flow paths (A; 22, 23, 24) that are installed within the holding valve (10).

On the other hand, if the spool (1) is shifted to the left with the auxiliary spool (9) shifted downwards in the figure, and the hydraulic fluid pressure drained from the back pressure chamber (11) of the holding poppet (8) is greater than the elastic force of the valve spring (30) of the pilot pressure control valve (20), the hydraulic fluid pressure of the back pressure chamber (11) passes through the fifth flow path (28) and is applied to the pressure receiving port of the pilot pressure control valve (20), thus shifting up the pilot pressure control valve (20).

As a result, due to the shift of the pilot pressure control valve (20), the outlet of the third flow path (24) is blocked from the inlet of the second pilot port (25). Also, the pilot pressure (Pi1) applied to the first pilot port (21) is blocked from being applied to the control valve by way of the flow paths (A) and the second pilot port (25). At this moment, the hydraulic fluid of the second pilot port (25) passes through the sixth flow path (29) formed within the pilot pressure control valve (20), moves to the back pressure chamber (26) of the pilot pressure control valve (20), and is drained through the fourth flow path (27) communicating with the back pressure chamber (26).

Referring to FIG. 4 and FIG. 5 of the control valve for construction equipment according to the present invention, the auxiliary spool (9) is installed within the holding valve (10) and is shifted by the hydraulic fluid which is drained from the back pressure chamber (11) of the holding poppet (8). For such principles, the pilot pressure (Pi1) is applied to the control valve (not shown in the figure) or blocked by the pilot pressure control valve (20) through the flow paths (A; 22, 23, 24). In the embodiment of the present invention, the pilot pressure control valve (20) is formed of the spool type. However, other types of valve would be practically same, and the specific descriptions of the other types are omitted.

Although the present invention has been described with reference to the preferred embodiment in the attached figures, it is to be understood that various equivalent modifications and variations of the embodiments can be made by a person having an ordinary skill in the art without departing from the spirit and scope of the present invention as recited in the claims.

According to the embodiment of the present invention having the above-described configuration, the supply paths of pilot pressure and the open and close valve are formed within a holding valve which prevents the work device from descending due to its own weight when the actuator like boom cylinder is in the neutral state, thereby saving the manufacturing cost as well as allowing better use of space.

What is claimed is:

1. A control valve for construction equipment comprising;

a valve body having a primp passage to which hydraulic fluid is supplied from a hydraulic pump, a supply passage that is configured to communicate with the pump passage, and actuator ports that is connected to an actuator;

a spool that is installed within the valve body and shifted to enable the hydraulic fluid of the hydraulic pump to be supplied to the actuator through one of the actuator ports, and to return the hydraulic fluid discharged from the actuator to the tank passage through the other of the actuator ports;

a holding valve that is provided with a holding poppet which is formed on one of the actuator ports and an auxiliary spool which is connected to a back pressure chamber of the holding poppet and shifted by a pilot pressure so as to release a holding load of the actuator; and a pilot pressure control valve that is shiftably installed within the holding valve and configured to apply or block the pilot pressure to the control valve through flow paths, wherein the pilot pressure control valve is to be shifted by a pressure of hydraulic fluid drained from the back pressure chamber of the holding poppet when the auxiliary spool is shifted.

2. The control valve for construction equipment of claim 1, wherein the actuator is a boom cylinder or arm cylinder.

3. The control valve for construction equipment of claim 1, wherein the pilot pressure control valve is formed of a poppet type pilot pressure control valve having a check function.

4. The control valve for construction equipment of claim 1, wherein the pilot pressure control valve is formed of a spool type pilot pressure control valve.

5. The control valve for construction equipment of claim 1, wherein the flow paths comprise;

a first flow path that is formed in the holding valve so that an inlet of the first flow path is communicating with a first pilot port to which the pilot pressure is applied so as to shift the auxiliary spool;

a second flow path with its inlet connected to an outlet of the first flow path; and a third flow path in which an outlet of the third flow path is communicating with a second pilot port to which the pilot pressure is applied while an inlet of the third flow path is connected to an outlet of the second flow path, wherein the outlet of the third flow path is opened or closed by the shift of the pilot pressure control valve.

6. The control valve for construction equipment of claim 1, wherein the holding valve includes a fourth flow path to which hydraulic fluid of a back pressure chamber of the pilot pressure control valve is drained when the pilot pressure control valve is shifted.

7. The control valve for construction equipment of claim 1, wherein the holding valve includes a fifth flow path in which hydraulic fluid drained from the back pressure chamber of the holding poppet is supplied to a pressure receiving port of the pilot pressure control valve when the auxiliary spool is shifted.

8. The control valve for construction equipment of claim 6, wherein the pilot pressure control valve includes a sixth flow path which selectively communicates the second pilot port with the back pressure chamber of the pilot pressure control valve in order to drain a pilot pressure of the second pilot port, if the pilot pressure applied to the control valve is blocked by the pilot pressure control valve which is shifted by a pressure of the hydraulic fluid drained from the back pressure chamber of the holding poppet when the auxiliary spool is to be shifted.

9. The control valve for construction equipment of claim 1, wherein when the pilot pressure control valve is shifted in an initial state it opens an inlet through which the pilot pressure is applied toile control valve so as to shift the auxiliary spool, and wherein, when the pilot pressure control valve is shifted to an on-state, hydraulic fluid is drained from the back pressure chamber of the holding poppet and applied to a pressure receiving port of the pilot pressure control valve shifting the auxiliary spool blocking the inlet so that the pilot pressure is not applied to the control valve.

10. The control valve for construction equipment of claim 1, wherein when the pilot pressure control valve is shifted in an initial state, it blocks an inlet so that the pilot pressure is not applied to the control valve, and wherein, when the pilot pressure control valve is shifted in an on-state, hydraulic fluid is drained from the back pressure chamber of the holding poppet and applied to a pressure receiving port of the pilot pressure control valve shifting the auxiliary spool and opening the inlet so that the pilot pressure is applied to the control valve.

* * * * *